United States Patent [19]

Lewis, Jr. et al.

[11] Patent Number: 4,685,586

[45] Date of Patent: Aug. 11, 1987

[54] BOILER PENTHOUSE ACCESS DOOR

[75] Inventors: Robert L. Lewis, Jr., Baxley, Ga.; J. Albert Hudson, Knoxville, Tenn.

[73] Assignee: Environmental Products & Services Co., Inc., Skillman, N.J.

[21] Appl. No.: 853,564

[22] Filed: Apr. 18, 1986

[51] Int. Cl.[4] ..... B65D 45/28; B65D 43/16

[52] U.S. Cl. ..... 220/305; 220/213; 220/215; 220/314

[58] Field of Search ..... 220/213, 215, 305, 314

[56] References Cited

U.S. PATENT DOCUMENTS

| | | | |
|---|---|---|---|
| 1,266,926 | 5/1918 | Dundon | 220/314 |
| 1,859,169 | 1/1933 | Mosel | 220/213 |
| 2,239,096 | 4/1941 | Holland | 220/215 |
| 2,285,935 | 6/1942 | Meyer | 220/213 |
| 2,301,365 | 11/1942 | Bushnell | 220/215 |
| 2,629,514 | 2/1953 | Savolainen | 220/314 |
| 2,883,043 | 4/1959 | Kurath | 220/314 |
| 4,313,025 | 1/1982 | Grube | 220/305 |

*Primary Examiner*—George E. Lowrance

*Attorney, Agent, or Firm*—Kimmel, Crowell & Weaver

[57] ABSTRACT

A door system for a boiler penthouse or other high temperature industrial environment is disclosed. A sufficiently large entranceway for both workmen and large equipment is provided by the door system. The access door has the capability for quick gas-tight sealing during closing. A hinged metal door plate has arcuate welding beads applied to its internal surface near its corners to produce permanent inward cupping of the door plate adjacent to its corners. Devices apply pressure to the exterior surface of the door plate during the closing thereof to flatten the inwardly cupped corners and effect gas-tight sealing of the interior surface of the door plate near its margin with an opposing high temperature resistant gasket carried by the front face of a refractory insulated door frame. A layer of thermal insulating material in a protective jacket is secured to the interior surface of the door plate.

14 Claims, 6 Drawing Figures

BOILER PENTHOUSE ACCESS DOOR

BACKGROUND OF THE INVENTION

1. Technical Field

This invention relates to a door system for high temperature industrial environments, such as an access door for a boiler penthouse.

2. Description of the Prior Art

U.S. Pat. No. 4,574,973, issued Mar. 11, 1986, for DOOR SYSTEM FOR PRECIPITATORS OR THE LIKE, discloses a quick-acting gas sealing access door for industrial applications which operates in a temperature range up to about 400° F. A normally flat metal door plate is equipped near its margin with a high temperature acid-resistant hollow core gasket which abuts a flat opposing frame plate when the door system is closed. A screw at the center of the door plate applies pressure inwardly against the door plate causing it to assume a concave configuration when closed to effect a gas-tight seal with the opposing frame plate. The patented access door is limited in its size and therefore is not completely suitable for applications where workers and/or large equipment must enter and leave an industrial device such as a boiler penthouse.

SUMMARY OF THE INVENTION

Entrance doorways are required on boiler penthouses and in other industrial locations where internal temperatures in the range of 500° F.–1000° F. exist to allow maintenance personnel and equipment to pass through the casing or wall of the installation periodically. In such high temperature applications, positive sealing of the access door is difficult because of expansion and warping of the door and its seating surface. If leakage occurs due to inadequate sealing, hot gases can escape or, when under negative pressure, cold ambient air can be drawn into the equipment. With some equipment, such as coal-fired power boilers, the escaping gas may contain particulate matter causing a small escaping stream of gas to abrade a gas passage of ever-increasing size. Because problems of sealing escalate as doors get larger, small access doors have historically been provided and for similar reasons quick opening mechanisms have been avoided.

Accordingly, the principal object of the present invention is to provide an access door for a boiler penthouse or the like capable of positive sealing, quick opening and closing, and having a size sufficient to allow ready access and egress of workers and large equipment through the doorway.

A further object of the invention is to provide an access door for a boiler penthouse which will provide continuous service at a temperature of about 800° F.

Another important object of the invention is to provide an access doorway of sufficient size to provide adequate ventilation while workmen are performing duties in the penthouse.

Still another object of the invention is to provide an access door for a boiler penthouse in which the door plate has thermal insulation on its interior surface and is cupped inwardly at least in its corner regions while in a relaxed state, the door plate becoming essentially flat under the application of pressure against its exterior surface to enable an effective seal against an opposing high temperature gasket around the front margin of a door frame.

Other features and advantages of the invention will become apparent to those skilled in the art during the course of the following detailed description.

DETAILED DESCRIPTION

Figure 1:
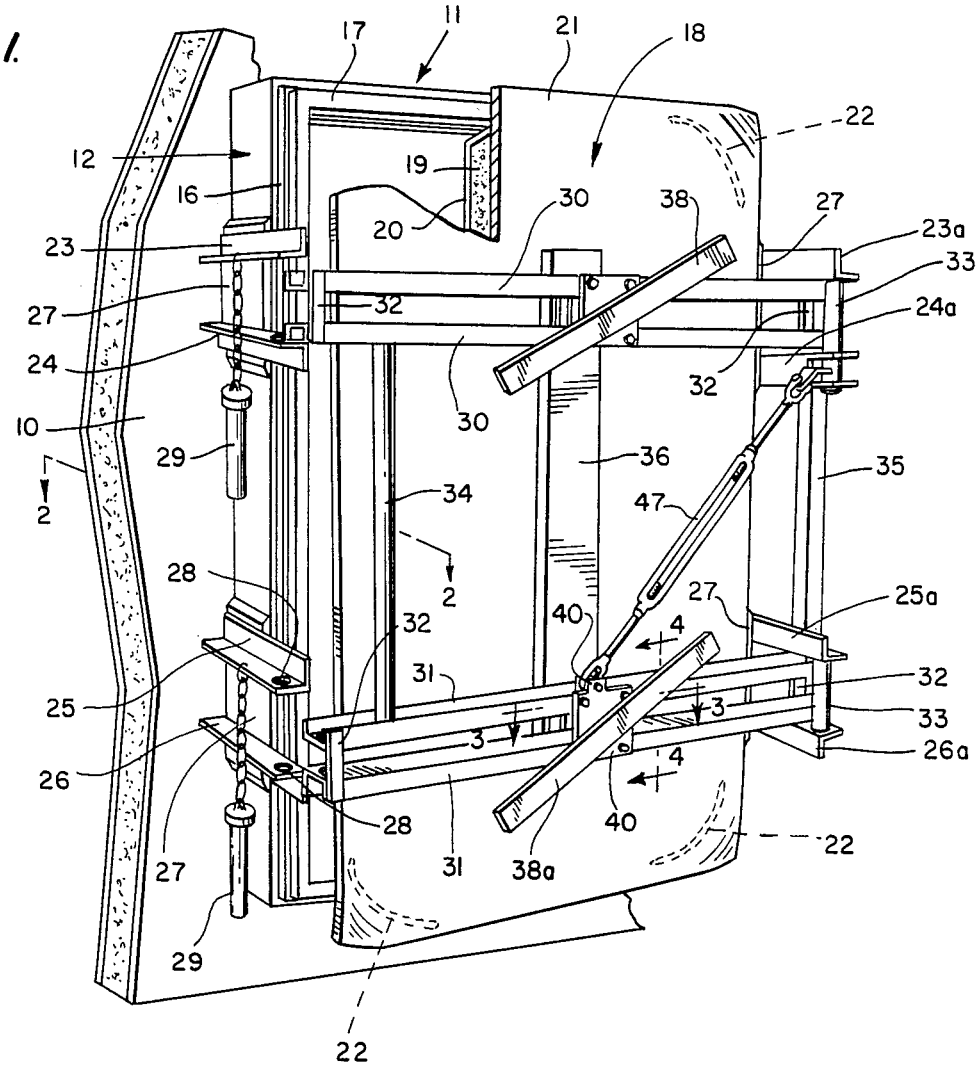
FIG. 1 is a perspective view, partly broken away and partly in section, of a boiler penthouse access door according to the present invention.

Referring to the drawings in detail wherein like numerals designate like parts, a boiler penthouse wall 10 is provided with a rectangular access opening 11 which may measure seven feet in height by about four feet horizontally to provide access and egress to and from the boiler penthouse for workers and relatively large equipment components. The penthouse wall 10 is thermally insulated as indicated in the drawings.

A rectangular access door frame 12 surrounds the margin of the opening 11 and is in the form of a channel member welded to the wall 10 externally and internally as at 13 and 14. The rectangular frame 12 is filled with refractory insulation 15. On its frontal vertical face, the door frame 12 carries a continuous channel member 16 receiving and holding a continuous rectangular cross section heat-resistant gasket 17, preferably a Thermo-Ceram 1000° F. gasket.

A steel rectangular door plate 18, such as a $\frac{3}{8}''$ plate, is provided on its interior side with an insulation layer 19 contained within a steel jacket 20 which is tack-welded at spaced intervals to the door plate around the margin of the jacket 20. The marginal edge portion 21 of the door plate 18 is adapted to abut the gasket 17 when the access door is fully closed, FIG. 2.

Figure 5:
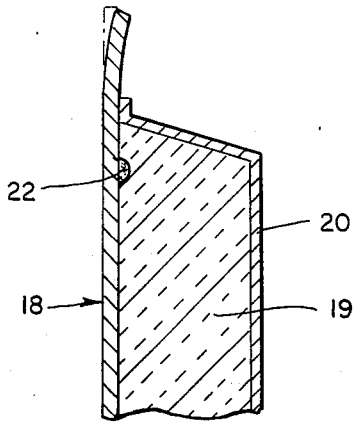
FIG. 5 is a fragmentary section taken through one corner of the door plate and its insulation on line 5—5 of FIG. 6.
Figure 6:
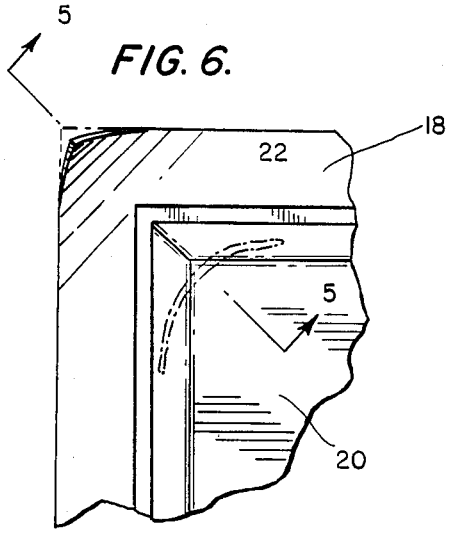
FIG. 6 is a fragmentary interior side elevation of the door plate and its insulation.

Prior to installing the insulation 19 on the interior of the door plate 18, arcuate weld beads 22 are applied to the inner face of the initially flat door plate near the four corners thereof. This application of the weld beads and the heat generated causes the corners of the door plate 18 to warp or cup inwardly, as shown on an exaggerated scale in FIGS. 1, 5 and 6. The inward warping of the door plate is most pronounced at its corners and also extends on a diminishing basis along significant lengths of the horizontal and vertical edges of the door plate 18. Subsequently, the insulation 19 and its jacket 20 are applied over the weld beads 22. The door plate 18, in a relaxed state, permanently assumes the above-described warped or cupped configuration with the four corners projecting inwardly toward the frame 12 prior to closing the access door.

Figure 2:
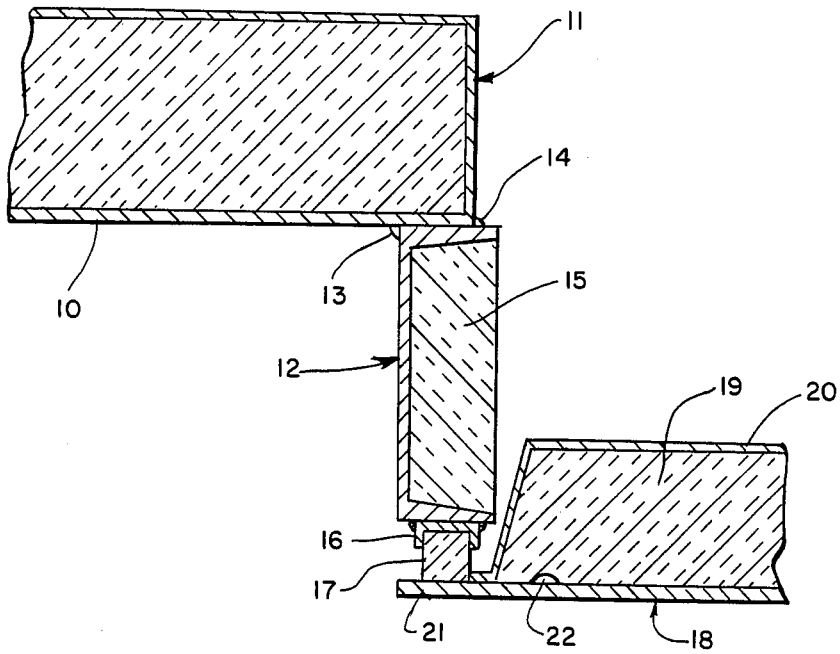
FIG. 2 is an enlarged fragmentary horizontal section with parts omitted taken substantially on line 2—2 of FIG. 1 with the access door completely closed.

When the door is fully closed and sealed by external pressure applying quick-release closure means, soon to be described, the inwardly cupped door comes into heavy sealing engagement with the gasket 17 and the reaction pressure against the interior of the door plate 18, caused by the gasket 17, returns the door plate 18 to a flat or nearly flat state, as indicated in FIG. 2. The arrangement assures a positive gas-tight seal between the door plate 18 and the frame 12 carrying the thermal gasket 17 in accordance with a very important feature of this invention.

The frame 12 is provided on its opposite vertical sides somewhat below its top and above its bottom with pairs of spaced horizontal angle bars 23-23*a*, 24-24*a*, 25-25*a* and 26-26*a*. These bars are welded to flat pads 27 provided on the opposite vertical sides of the frame 12. The angle bars, which are all of the same length, extend horizontally forwardly of the frame 12, FIG. 1. The forward ends of the bars 23, 24, 25 and 26 have apertures 28 adapted to receive tethered locking pins 29 therethrough when the door plate 18 is closed into contact with the gasket 17.

Upper and lower pairs of spaced parallel horizontal back-to-back channel bars 30 and 31 span the door plate 18 and frame 12 horizontally. The opposite ends of the bars 30 and 31 are connected by welded braces 32. The end portions of the channel bars 30 and 31 adjacent to the apertured angle bars 23, 24, 25 and 26 are similarly apertured to receive the locking pins 29 when the apertures of the channel bars are in registration with the apertures 28, which occurs when the door plate 18 abuts the gasket 17.

The other ends of the channel bars 30 and 31 are welded to sleeves 33 journaled on vertical axis hinge pins extending between the forward ends of the bars 23*a*-24*a* and 25*a*-26*a*. Brace members 34 and 35 may also be connected between the lower bar 30 and upper bar 31 and between the bars 24*a* and 25*a* for further rigidity.

A wide vertical channel member 36 at the transverse center of the door plate 18 is welded to its outer face and this channel member extends beneath and across the pairs of channel bars 30 and 31. Door plate pressurizing and releasing screws 37 and 37*a* equipped at their forward ends with turning handle bars 38 and 38*a* are preferably formed of stainless steel. The axes of these screws are parallel and the axes are perpendicular to the plane of the door plate 18. The screws 37 and 37*a* have threaded engagement with nuts 39 welded to the interiors of square plates 40 fixed to the forward faces of the channel bars 30 and 31 at their longitudinal centers. Additional plates 41 are welded to the rear faces of the bars 30 and 31 and are apertured to receive the door pressurizing and sealing screws 37 therethrough rotatably. The unthreaded shanks of the screws 37 and 37*a* nearest the door plate 18 are adapted to bear on the channel member 36 through which sealing pressure is applied to the exterior of the door plate 18 after the locking pins 29 have been installed through the apertures of the bars 23, 24, 25 and 26 and the registering apertures of the bars 30 and 31.

Figure 3:
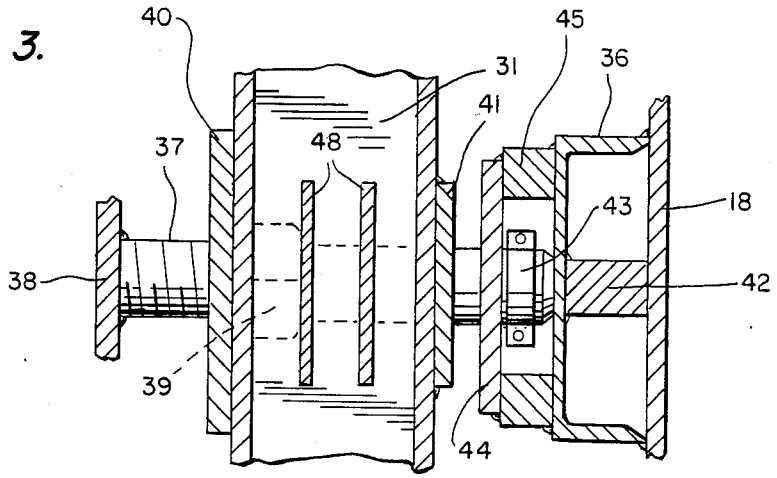
FIG. 3 is an enlarged fragmentary horizontal section taken substantially on line 3—3 of FIG. 1.
Figure 4:
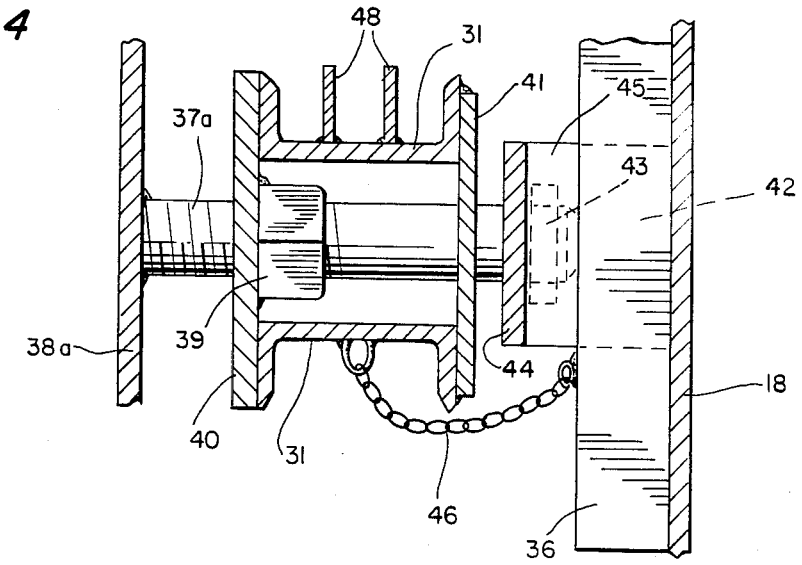
FIG. 4 is an enlarged fragmentary vertical section taken substantially on line 4—4 of FIG. 1.

The channel member 36 is reinforced directly adjacent to the screws 37 and 37*a* by welded spacer bars 42. Retention collars 43 on the unthreaded shanks of the screws 37 and 37*a* are captively held in chambers defined by plates 44 welded to bars 45, in turn welded to the vertical channel member 36. Safety chains 46 are preferably provided to interconnect the lower channel bars 30 and 31 with the vertical channel member 36. A door sag adjustment turnbuckle 47 is connected between the upper sleeve 33 and a pair of lugs 48 fixed on the upper bar 31 by welding, as best shown in FIGS. 3 and 4.

When the access door is swung to the closed position on the frame 12, it travels horizontally around the vertical axes of the hinge sleeves 33 until the door plate 18 contacts the gasket 17. At this time, the locking pins 29 are installed through the apertures of bars 23, 24, 25 and 26 and the registering apertures of the bars 30 and 31. This effectively locks the door plate 18 closed. Next, the two screws 37 and 37*a* are tightened by use of the handles 38 and 38*a* and heavy pressure is applied to the exterior face of door plate 18 at two locations midway between the vertical edges of the door plate and between its inwardly warped corners. This pressure is distributed by the channel member 36. The pressure on the door plate serves to flatten out the inwardly warped or cupped portions of it and, in so doing, forces the door plate into tight gas-sealing relationship with the thermal gasket 17 which is now under compression around the entire perimeter of the frame 12. Since the inward cupping of the door plate 18 is concentrated at the corners of the door plate, an effective seal with the gasket 17 is assured at the four corners, and these are the regions where gas leakage could occur if the warped or cupped constructions of the door plate 18 were not utilized.

In order to break the seal and quickly release the access door for opening, it is merely necessary to back off the two screws 37 and 37*a* slightly to relieve pressure on the door plate, followed by the removal of the locking pins 29.

The construction of the boiler penthouse access door is simplified, extremely sturdy and convenient to operate. The two main objectives of the invention, namely, the provision of positive sealing around the entire door with quick opening and closing means and the provision of a sufficiently large access door opening for workers and large equipment to pass through are fully achieved.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A boiler penthouse access door comprising a door frame defining an entranceway through a wall of a boiler penthouse and having a sealing gasket on an exterior face thereof around the perimeter of said frame, a door plate hingedly attached to said frame for swinging movement between closed and open positions relative to said entranceway, releasable locking means on said frame and door plate whereby the door plate can be positively held substantially in engagement with said gasket, said door plate being inwardly warped adjacent to corners thereof and adjacent to corresponding corners of said frame, and means carried by the door plate to apply inward pressure to the exterior of the door plate while the door plate is locked in the closed position to thereby substantially flatten the door plate adjacent to said inwardly warped corners for providing a tight seal between the interior of the door plate and said gasket around the perimeter of said frame.

2. A boiler penthouse access door as defined in claim 1, and a body of thermal insulation on the interior of the door plate projecting somewhat into said frame when the door is in a closed position relative to the frame.

3. A boiler penthouse access door as defined in claim 2, and the door frame being provided with thermal insulation around the perimeter thereof.

4. A boiler penthouse access door as defined in claim 1, and said releasable locking means including an apertured member attached to one side of said frame, a coacting apertured member attached to said door plate and projecting beyond a corresponding side thereof, and a rigid locking element insertable removably through registering apertures of said apertured members.

5. A boiler penthouse access door as defined in claim 1, and said last-named means comprising at least a pressure screw on the door plate turnable in one direction to apply pressure against the exterior of the door plate between the corners thereof 6. A boiler penthouse access door as defined in claim 1, and said last-named means including a pair of pressure screws on the door plate near the top and bottom thereof and substantially midway between top and bottom inwardly warped corners of the door plate to apply pressure to the exterior of the door plate for flattening out said inwardly warped corners.

7. A boiler penthouse access door as defined in claim 6, and pairs of bars on said door plate extending horizontally thereacross near the top and bottom of the door plate and carrying said pressure screws, and corresponding ends of said pairs of bars being hingedly attached to one side of the door frame remote from said releasable locking means.

8. A boiler penthouse access door as defined in claim 1, and a door plate sag preventing adjustable means connected between the door frame and said door plate.

9. A boiler penthouse access door as defined in claim 1, and arcuate weld beads applied to the interior surface of said door plate near the corners thereof to cause said inward warping of the door plate adjacent to said corners.

10. A boiler penthouse access door as defined in claim 1, and said door frame and door plate being rectangular and being somewhat elongated vertically and being sized so that said entranceway is large enough to allow free passage therethrough of workers and equipment components.

11. An access doorway for high temperature equipment comprising a thermally insulated door frame defining an entranceway into the interior of said equipment, a heat-resistant gasket on the front face of said frame and extending continuously around the margin of the frame, a metal door plate hingedly connected with one side of said frame and being thermally insulated on its interior surface, interengaging means on said frame and door plate to releasably lock the door plate closed relative to the frame, welding on the interior of the door plate near corners thereof causing said corners to warp inwardly toward corners of the frame, and means carried by the door plate and being operable to apply pressure to the exterior of the door plate to cause flattening out of the inwardly warped corners of the door plate and to force the interior of the door plate into tight sealing engagement with said gasket entirely around the perimeter of said frame.

12. An access doorway for high temperature equipment as defined in claim 11, and a channel element on the front face of said frame holding said gasket.

13. An access doorway for high temperature equipment as defined in claim 11, and said interengaging means comprising registering apertured locking members on said frame and door plate, and locking pins insertable removably through the apertures of said locking members.

14. An access doorway for high temperature equipment as defined in claim 11, and said last-named means comprising pressure screws on said door plate substantially at the transverse center thereof and having axes substantially perpendicular to the plane of the door plate.

* * * * *